US008261401B1

(12) United States Patent
Ciesielski

(10) Patent No.: US 8,261,401 B1
(45) Date of Patent: Sep. 11, 2012

(54) CLEANING TOOL DEVICE FOR VERTICAL BLINDS

(76) Inventor: Maria Ciesielski, Hickory Hills, IL (US)

( * ) Notice: Subject to any disclaimer, the term of this patent is extended or adjusted under 35 U.S.C. 154(b) by 33 days.

(21) Appl. No.: 13/044,931

(22) Filed: Mar. 10, 2011

(51) Int. Cl.
*A47L 4/02* (2006.01)

(52) U.S. Cl. ..... 15/220.3; 15/104.93

(58) Field of Classification Search ..... 15/104.93, 15/220.3
See application file for complete search history.

(56) References Cited

U.S. PATENT DOCUMENTS

| | | | | |
|---|---|---|---|---|
| 2,134,965 | A | 11/1938 | Zbarsky | |
| D122,411 | S | 9/1940 | Marks et al. | |
| 2,663,046 | A * | 12/1953 | Goguen | 15/394 |
| 2,789,307 | A * | 4/1957 | Sussman et al. | 15/394 |
| 2,856,625 | A | 10/1958 | Decacretaz | |
| 4,435,874 | A | 3/1984 | Jacobson | |
| 4,718,141 | A | 1/1988 | Kuehnl | |
| 4,787,118 | A | 11/1988 | Weiland et al. | |
| 7,430,781 | B2 * | 10/2008 | Collins | 15/220.3 |
| 2008/0172810 | A1 * | 7/2008 | Jaeger | 15/21.1 |

* cited by examiner

*Primary Examiner* — Randall Chin

(57) ABSTRACT

The present invention is directed to a cleaning tool for hanging blinds. The cleaning device of the present invention provides an easier and more convenient way of cleaning vertical blinds.

5 Claims, 5 Drawing Sheets

TOP VIEW

SIDE VIEW

CROSS SECTIONAL VIEW

CROSS SECTIONAL VIEW

CLEANING TOOL DEVICE FOR VERTICAL BLINDS

BACKGROUND OF THE INVENTION

The present invention is directed to a cleaning tool for hanging blinds. The cleaning device 100 of the present invention provides an easier and more convenient way of cleaning vertical blinds.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
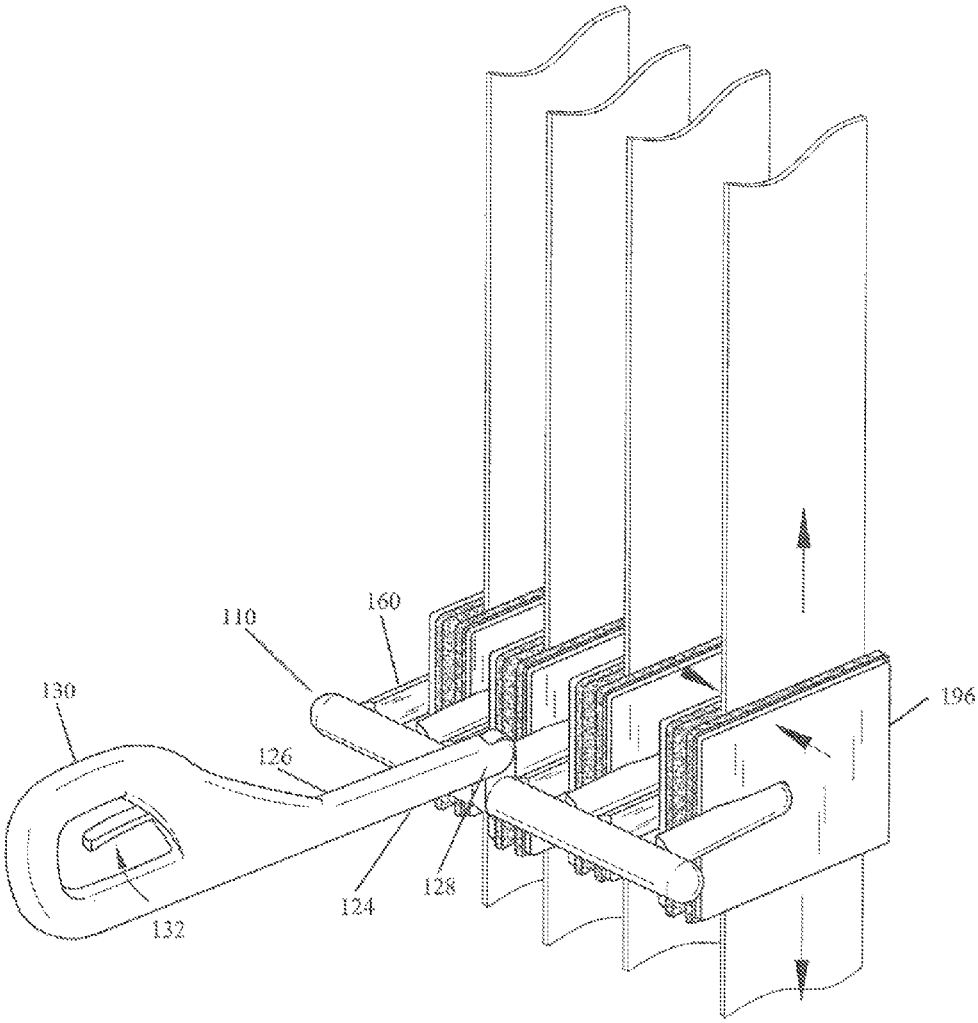
FIG. 1 shows perspective view of the cleaning tool device.
Figure 2:
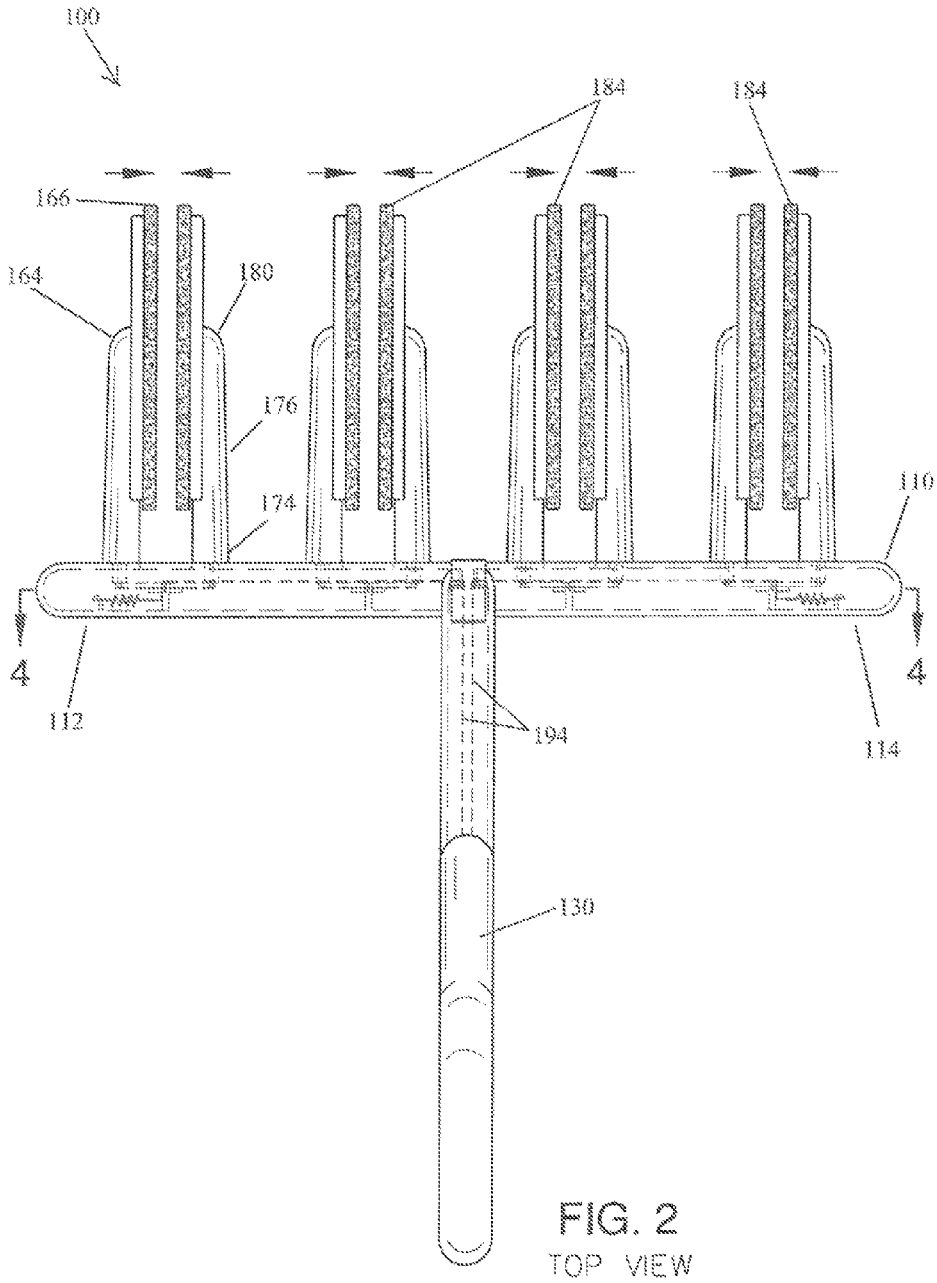
FIG. 2 shows a top view of the cleaning tool device.
Figure 3:
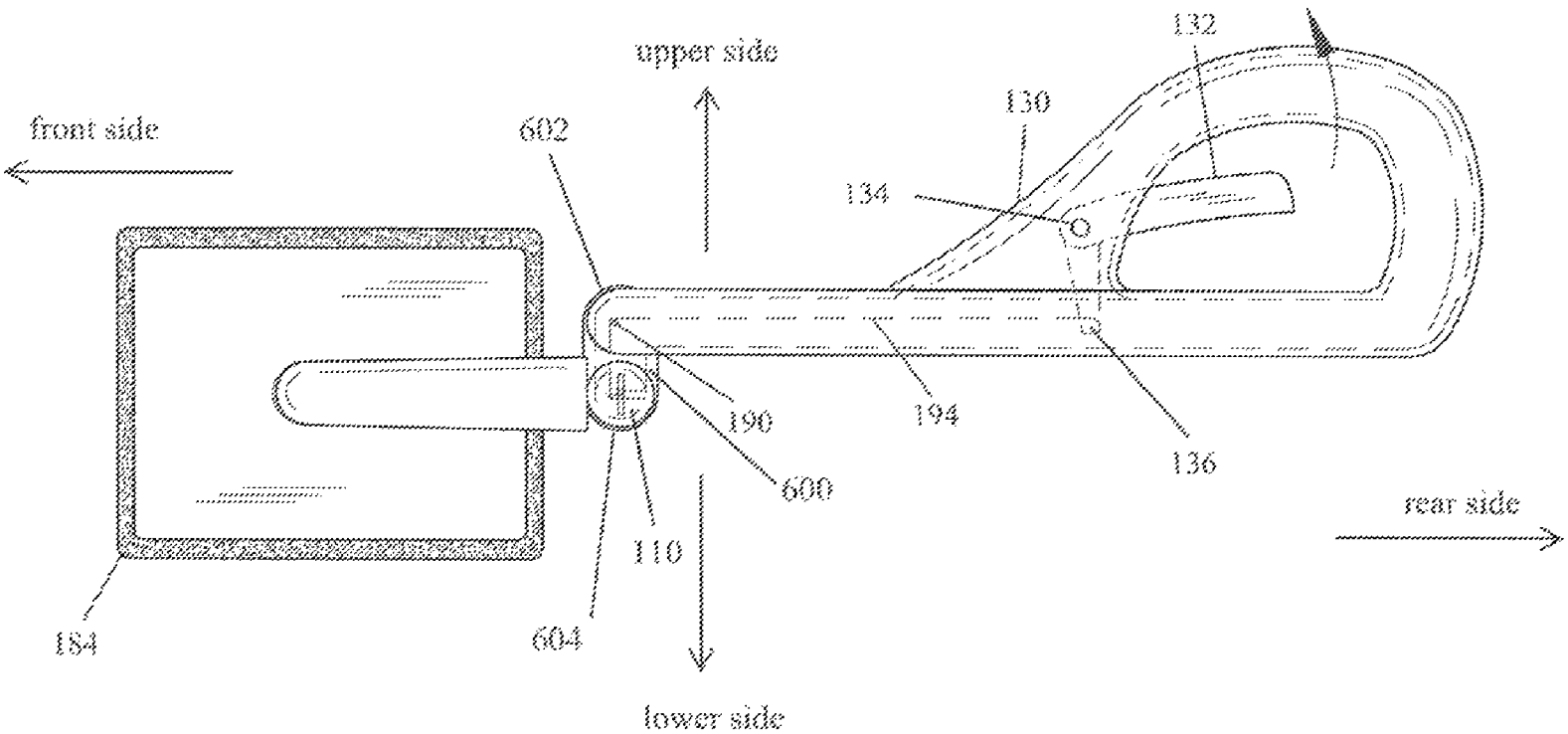
FIG. 3 shows a side view of the cleaning tool device.
Figure 4A:
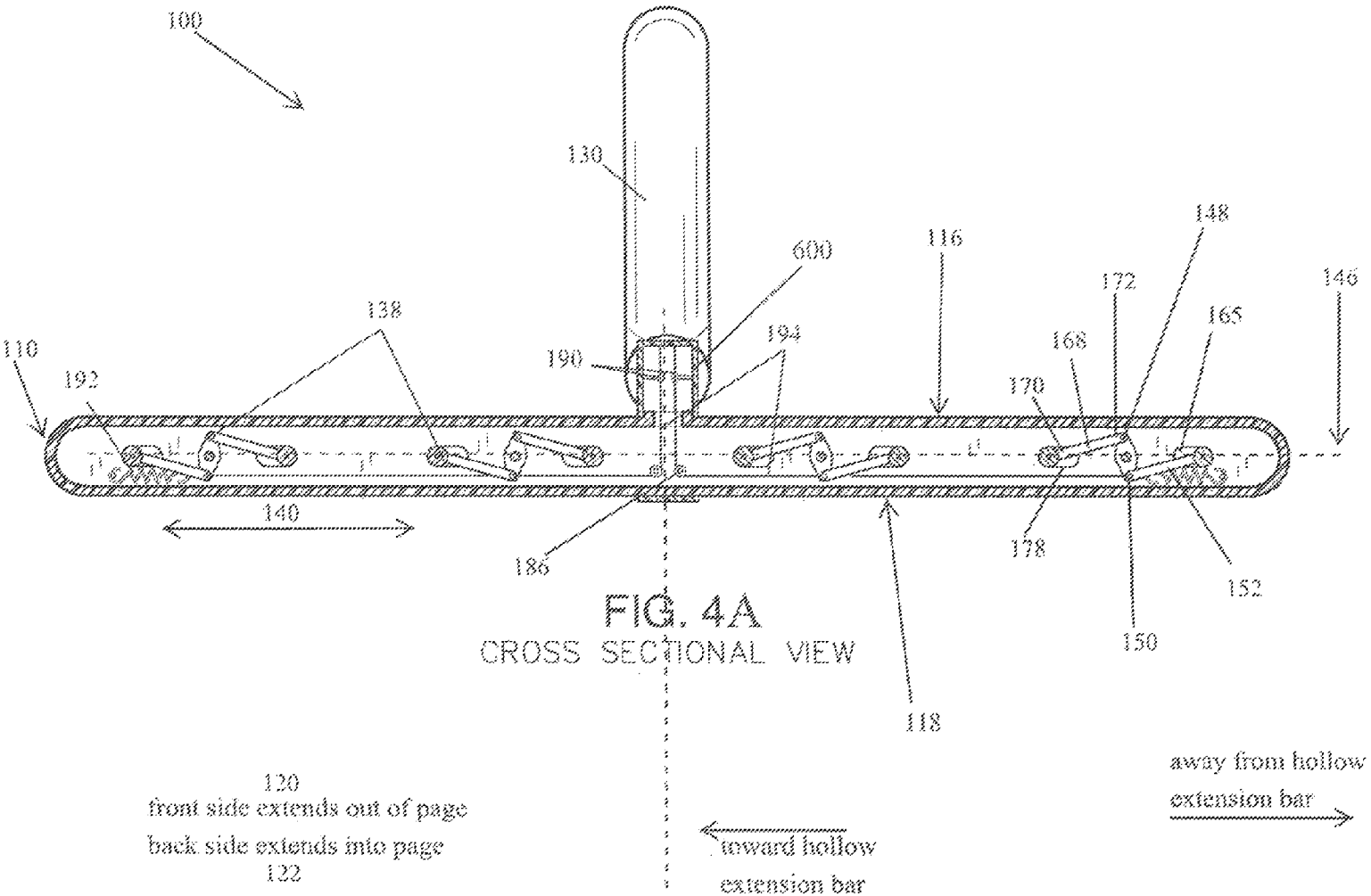
FIG. 4A shows a cross-sectional front view of the cleaning tool device.
Figure 4B:
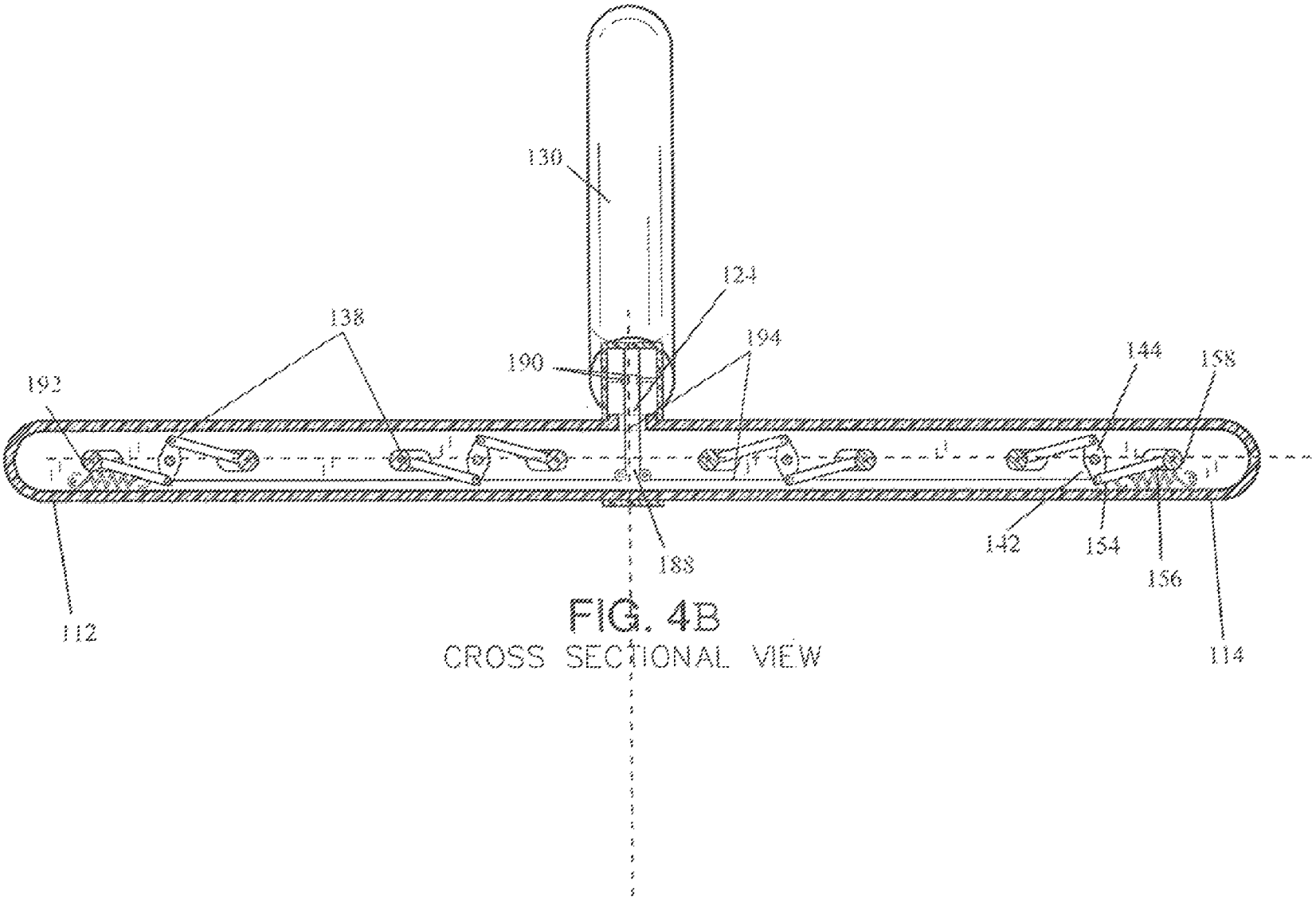
FIG. 4B shows another cross-sectional front view of the cleaning tool device.

Referring now to FIGS. 1-4B, the present invention features a cleaning device 100 for hanging blinds which comprises a hollow elongated base 110 having a first end 112 and a second end 114, an upper side 116 and a lower side 118, a front side 120 and a rear side 122.

The device 100 further comprises a hollow extension bar 124 having a first end 126 and a second end 128. In some embodiments, the first end fluidly connects to the base. An at least partially hollow handle 130 fluidly connects to the second end of the extension bar and extends outwardly from the extension bar.

The device further comprises an L-shaped trigger 132 pivotably disposed within the handle where the L-shaped trigger pivots about on its vertex 134. A first end 136 of the L-shaped trigger extends into the hollow extension bar, while a plurality of squeezing mechanisms 138 are disposed within and along a length 140 of the hollow elongated base. In some embodiments, each squeezing mechanism comprises a crank 142 comprising a central attachment point 144 lying on a mid-line 146. An upper side facing attachment point 148 lies within the region between the mid-line and the upper side of the hollow elongated base and a lower side facing attachment point 150 lies between the region between the mid-line and the lower side of the hollow elongated base.

The device further comprises a lower side lever 152 having a first end 154 and a second end 156. The first end of the lower side lever pivotably attaches to the lower side facing attachment point. The second end of the lower side lever pivotably attaches to a first end 158 of a lower side pad bar 160, wherein the lower side pad bar projects through a lower side elongated slot 162 disposed on the front side of the hollow elongated base and along the mid-line. A second end 164 of the lower side pad bar comprises a pad 166, and an upper side lever 168 having a first end 170 and a second end 172, wherein the pad disposed on a pad bar 196 is removable. In some embodiments, the first end of the upper side lever pivotably attaches to the upper side facing attachment point. The second end of the upper side lever pivotably attaches to a first end 174 of an upper side pad bar 176, wherein the upper side pad bar projects frontward through an upper side elongated slot 178 disposed on the front side of the hollow elongated base and along the mid-line. In some embodiments, a second end 180 of an upper side pad bar 182 comprises a pad 184. In some embodiments, a side-to-side pulley 186 is disposed in the region between the mid-line and the lower side of the hollow elongated base and at a juncture 188 between the hollow extension bar and the elongated base.

In some embodiments, a front-to-back pulley 190 is disposed at the first end of the hollow extension bar. In some embodiments, a return spring 192 attaches to and pulls onto the lower side facing attachment point of the lever directly. The return spring pulls in a direction away from the hollow extension bar and causes the lower side pad bar and the upper side pad bar to slide away from each other. The lower side pad bar and the upper side pad bar slide within the lower side slot and the upper side slot, respectively.

The device further comprises a taught cable 194 attaching the lower side facing attachment point of the lever to the first end of the L-shaped trigger, wherein in between the taught cable loops through the side-to side pulley and the front-to-back pulley, wherein when the L-shaped trigger is compressed toward the handle, the taught cable pulls on the lower side facing attachment point toward a direction of the hollow extension bar, whereby causing the lower side pad bar and the upper side pad bar to slide toward each other, the lower side pad bar and the upper side pad bar slide within the lower side slot and the upper side slot, respectively. Having the pads close onto the blinds ensures a more thorough cleaning.

In some embodiments, the cleaning tool device comprises two squeezing mechanisms disposed within the hollow extension base. In some embodiments, the cleaning tool device comprises three squeezing mechanisms disposed within the hollow extension base. In some embodiments, the cleaning tool device comprises four squeezing mechanisms disposed within the hollow extension base. Having multiple squeezing mechanisms allows for faster cleaning of the blinds.

In some embodiments, the device further comprises a connector 600 which has a first end 602 and a second end 604, wherein the connector is hollow inside. The first end 602 of the connector fluidly (and pivotably) connects with the second end of the extension bar, and the second end 604 of the connector fluidly connects with the extension base. The taught cable 194 can travel as before, but when there is a connector 600 in place between the extension bar and the elongated base, the taught cable 194 travels from the extension bar through the connector and then to the elongated base.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A cleaning device 100 for hanging blinds, the device comprising:

(a) a hollow elongated base 110 having a first end 112 and a second end 114, an upper side 116 of the hollow elongated base and a lower side 118 of the hollow elongated base, a front side 120 of the hollow elongated base and a rear side 122 of the hollow elongated base;

(b) a hollow extension bar 124 having a first end 126 and a second end 128, the first end fluidly connected to the base;

(c) an at least partially hollow handle 130 fluidly connecting to the second end of the extension bar and extending outwardly from the extension bar;

(d) an L-shaped trigger 132 pivotably disposed within the handle where the L-shaped trigger pivots about on its vertex 134, a first end 136 of the L-shaped trigger extends into the hollow extension bar, (e) a plurality of squeezing mechanisms 138 disposed within and along a length 140 of the hollow elongated base 110, wherein each squeezing mechanism comprises:

(i) a crank 142 comprising a central attachment point 144 lying on a mid-line 146, an upper side facing attachment point 148 lying within the region between the mid-line and the upper side of the hollow elongated base and a lower side facing attachment point 150 lying between the region between the mid-line and the lower side of the hollow elongated base, (ii) a lower side lever 152 having a first end 154 and a second end 156, the first end of the lower side lever pivotably attaches to the lower side facing attachment point, the second end of the lower side lever pivotably attaches to a first end 158 of a lower side pad bar 160, wherein the lower side pad bar projects through a lower side elongated slot 162 disposed on the front side of the hollow elongated base and along the mid-line, a second end 164 of the lower side pad bar comprises a pad 166, (iii) an upper side lever 168 having a first end 170 and a second end 172, the first end of the upper side lever pivotably attaches to the upper side facing attachment point, the second end of the upper side lever pivotably attaches to a first end 174 of an upper side pad bar 176, wherein the upper side pad bar projects frontward through an upper side elongated slot 178 disposed on the front side of the hollow elongated base and along the mid-line, a second end 180 of an upper side pad bar 182 comprises a pad 184, (f) a side-to-side pulley 186 disposed in the region between the mid-line and the lower side of the hollow elongated base and at a junction 188 between the hollow extension bar and the elongated base, (g) a front-to-back pulley 190 disposed at the first end of the hollow extension bar, (h) a return spring 192 attaching to and pulling onto the lower side facing attachment point of the lever directly, the return spring pulls in a direction away from the hollow extension bar and causes the lower side pad bar and the upper side pad bar to slide away from each other, the lower side pad bar and the upper side pad bar slide within the lower side slot and the upper side slot, respectively;

(i) a taught cable 194 attaching the lower side facing attachment point of the lever to the first end of the L-shaped trigger, wherein in between the taught cable loops through the side-to side pulley and the front-to-back pulley, wherein when the L-shaped trigger is compressed toward the handle, the taught cable pulls on the lower side facing attachment point toward a direction of the hollow extension bar, whereby causing the lower side pad bar and the upper side pad bar to slide toward each other, the lower side pad bar and the upper side pad bar slide within the lower side slot and the upper side slot, respectively.

2. The device of claim 1 comprising two squeezing mechanisms disposed within the hollow extension base.

3. The device of claim 1 comprising three squeezing mechanisms disposed within the hollow extension base.

4. The device of claim 1 comprising four squeezing mechanisms disposed within the hollow extension base.

5. The device of claim 1 wherein the pad disposed on a pad bar 196 is removable.

* * * * *